US008299911B2

(12) United States Patent
Buss

(10) Patent No.: US 8,299,911 B2
(45) Date of Patent: Oct. 30, 2012

(54) TESTING DEVICE FOR HAZARD ALARM SYSTEMS

(75) Inventor: Matthias Buss, Bad Oldesloe (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 188 days.

(21) Appl. No.: 12/928,864

(22) Filed: Dec. 21, 2010

(65) Prior Publication Data

US 2011/0150188 A1 Jun. 23, 2011

(30) Foreign Application Priority Data

Dec. 22, 2009 (DE) ..... 10 2009 060 418

(51) Int. Cl.
*G08B 29/00* (2006.01)
*G08B 23/00* (2006.01)

(52) U.S. Cl. ..... 340/514; 340/507; 340/508; 340/515; 340/516; 340/525

(58) Field of Classification Search ..... 379/1.01, 379/9.02, 27.01, 27.04, 29.03, 29.04, 29.1, 379/35, 42–44, 50; 340/507, 508, 514, 515, 340/516, 518, 525, 506
See application file for complete search history.

(56) References Cited

U.S. PATENT DOCUMENTS

| | | | | |
|---|---|---|---|---|
| 3,889,184 | A * | 6/1975 | Bass | 324/713 |
| 6,563,910 | B2 * | 5/2003 | Menard et al. | 379/45 |
| 7,292,142 | B2 * | 11/2007 | Simon et al. | 340/539.17 |
| 7,965,178 | B1 * | 6/2011 | Schmuttor et al. | 340/506 |
| 2005/0200453 | A1 * | 9/2005 | Turner et al. | 340/5.61 |
| 2010/0011144 | A1 | 1/2010 | Ristau et al. | |
| 2011/0273283 | A1 * | 11/2011 | Schmuttor et al. | 340/506 |

FOREIGN PATENT DOCUMENTS

| | | |
|---|---|---|
| DE | 966 199 | 7/1957 |
| DE | 20 2008 009 211 | 10/2008 |
| DE | 10 2008 003 799 | 7/2009 |

* cited by examiner

*Primary Examiner* — Binh Tieu
(74) *Attorney, Agent, or Firm* — Collard & Roe, P.C.

(57) ABSTRACT

A testing device for hazard alarm systems, particularly fire alarm systems, having a hazard alarm control panel connected with a variety of devices via a device loop configured as a ring bus system, and has at least one communication circuit for communication with the individual devices. The communication circuit comprises multiple functional units. The current measurement unit is checked and monitored by a device simulation unit that is completely integrated into the communication circuit and is controlled by a control unit configured as a microcontroller.

14 Claims, 4 Drawing Sheets

TESTING DEVICE FOR HAZARD ALARM SYSTEMS

CROSS REFERENCE TO RELATED APPLICATIONS

Applicant claims priority under 35 U.S.C. 119 of German Application No. 10 2009 060 418.9 filed Dec. 22, 2009.

BACKGROUND OF THE INVENTION

1. Field of the Invention

The invention relates to a testing device for hazard alarm systems, particularly for their communication circuit, which is responsible for data communication and for control of a plurality of devices connected by way of a device loop.

2. The Prior Art

Since hazard alarm systems are supposed to warn the owners or operators of endangered industrial facilities or storage facilities before the occurrence of major damage due to fires, chemicals, or other hazardous substances, in as timely a manner as possible, so that suitable countermeasures can be taken, great demands are made on their reliability and operational safety.

For this reason, such systems, particularly fire alarm systems for detecting fires and extinguishing controllers for extinguishing fires, must function in reliable and problem-free manner over extended periods of time, under different requirements and operating conditions.

In order to keep the alarm and system technology that is used free of problems over many years, it must be possible to recognize all the error sources that can occur over the course of the time of operation under real ambient conditions, and particularly in rough industrial areas, at an early point in time, to report them, and to eliminate them, if at all possible.

Because of the rapid spread of hazardous situations, such as fires, toxic gases, or the like, during a short period of time, rapid and reliable detection, alarm triggering, and combating are particularly important. This particularly relates to the proper functioning of the hazard or fire alarm that stands at the tip of the signal chain.

Functional problems, not only of the connection lines used as supply lines and signal connection lines (wire connections), but also of their interfaces and contacts, as well as deviations in the functionality of the individual subscribers, particularly their operating parameters, must be recognized quickly, reported to the control center, and eliminated as quickly as possible. These are, in particular, short circuit, wire break, or absence of devices on the device loop.

In the following, a device loop is understood to be a ring bus system in which devices that can be individually addressed (for example in hazard detectors, fire detectors, actuators, etc.) are connected with a hazard alarm control panel by way of a connection line, which ensures not only the supply of power but also the data transmission. The connection line can be configured as a two-wire line, for example, but it can also comprise multiple lines. A hazard alarm control panel (HACP) can be configured, for example, as a fire alarm control panel (FACP), an extinguishing control panel, a combined fire alarm and extinguishing control panel, an intrusion control panel, an emergency control panel, a gas alarm control panel, etc. A hazard alarm system (HAS) is the term for all of the devices/participants, etc., connected with the control panel in question, and the control panel, which is ready for operation. A possible variant of a HAS is a fire alarm system (FAS).

The occurrence of functional problems on device loops is taken into account by means of constant monitoring and regular checks of the alarm devices.

In this connection, however, not only do the peripheral devices connected with a hazard alarm control panel have to be monitored, but also the functionality of the circuit parts of the hazard alarm control panel itself has to be monitored.

In the following, the term "device" is supposed to be understood to mean any type of sensor, detector, hazard detector, fire detector, alarm transmitter, emergency call device, or control and switching device for control or shut-off of devices such as air conditioning or extinguishing systems, which are connected with a hazard alarm control panel, particularly as alarms, by way of a connection line, as line modules.

The communication circuit can be implemented both as a fixed component of the HAS (for example a single-board system) or as a module controlled by the microprocessor system of the HAS, or as an independent module having its own microprocessor system, in a modular HAS.

In this connection, the present invention particularly relates to a communication circuit disposed in a hazard alarm control panel, which circuits are particularly responsible for data exchange and monitoring of the individual subscribers connected with the connection line.

It is known that the data communication between the communication circuit and the devices takes place by way of a ring bus system and a data transfer controller, in most cases, preferably in bit-serial form and in half-duplex mode.

In this connection, the data of the devices that can be individually addressed by way of the ring bus system are modulated up to the supply voltage made available by the hazard alarm control (HACP).

To monitor the data traffic and the supply voltage of the device loop, in other words of the connection line and its devices, the communication circuit usually has different functional units that are switched one behind the other.

These are preferably a functional unit for the voltage supply of the device loop, a voltage pulse generator for modulation of the supply voltage of the HACP, and a voltage measurement unit for checking proper modulation of the supply voltage.

Since the devices respond to the data packets received by modulated voltage pulses by modulating their power consumption, a current measurement unit for detection of the device response (current increase) furthermore follows. Important conclusions concerning the functioning ability of the connection line and of the individual devices can be drawn from the detection of the current increase response by this current measurement unit.

An output unit for connecting the hazard or fire alarm control panel (FACP) to the device loop, in terms of circuit technology, follows as an additional functional unit.

By switching the output unit, it is possible to separate the device loop from the HACP/FACP and to connect it.

The aforementioned functional units of the communication circuit are controlled by an integrated control unit, which is preferably configured as a microprocessor system.

In order to guarantee the functional safety of a hazard alarm system, in other words the hazard alarm control panel with one or more device loops connected with it, various monitoring mechanisms and tests of the participating modules and device in the device loops are required.

However, not only the functionality and operational safety of the connected device loop, but also reliable functioning of the hazard alarm system and its modules themselves are important for safe operation of a hazard alarm system.

Therefore it is necessary, for safety-technology reasons, to regularly check the communication circuit that is responsible for the power supply and the data traffic with the device loops, and to monitor it for proper functioning. Numerous methods and circuit arrangements are known from the literature, particularly for monitoring the functionality of loop devices.

For example, German Patent Application No. DE 10 2008 003 799 A1 describes a monitoring device configured as a module for monitoring the operating state of supply and/or signal lines, which is suitable and configured for integration into an alarm system.

In particular, wire breaks and short circuits that are about to happen are supposed to be detected with this known monitoring device.

Another device for recognizing interruptions on a ring bus that are about to happen is known from German Patent Application No. DE 20 2008 009 211 U1.

In the German Patent DE 966199, a testing device for reception control centers of alarm systems is indicated, with which devices accommodated in the reception control center, such as relays, dialers, display and recording elements, are subjected to testing. For this purpose, the alarm loop is uncoupled from the control center, and a line simulation device equipped with test alarms of the same construction and a line simulation device with defect simulation points, such as the alarm loop, and in the form of an external test kit, is coupled to the control center. However, here, real alarms having the same construction are required to check the telephone relays, and no adjustment possibilities are provided for testing parameters of different alarms.

However, none of these monitoring and testing devices that have been presented are capable of or are designed for testing the control and communication circuits that are responsible for control and signal transmission of the alarm systems, in the hazard alarm or fire alarm control panels, on their own, in an automated, rapid and flexible manner.

This particularly holds true for monitoring devices in which alarm systems of different constructions are used.

SUMMARY OF THE INVENTION

It is therefore an object of the present invention to create a testing device for hazard alarm systems, preferably for fire alarm systems, which avoids the disadvantages of the known solutions and is capable of reliably testing and monitoring the functioning ability of communication and control modules and their functional units.

This task is accomplished according to the invention by a testing device for hazard alarm systems having a ring bus system and devices connected with it. The testing device has a device simulation unit that preferably is integrated into the communication circuit of the hazard alarm control panel, and allows testing of the functional units of the hazard alarm control panel without the device loop having to be connected with a plurality or individual devices.

The device simulation unit can be completely integrated into the communication circuit of the hazard alarm system. However, it is also possible to dispose the device simulation unit externally.

It is advantageous if the communication circuit comprises functional units such as a voltage supply of the device loop, a control unit preferably configured as a microprocessor, a voltage pulse generator, a voltage measurement unit, a current measurement unit, an output unit, and at least one device simulation unit. The functional units can be switched one behind the other in the following sequence: voltage supply, voltage pulse generator, voltage measurement unit, current measurement unit, device simulation unit, output unit, connection of the device loop by means of connection line and ring bus system. The functional units are switched to the control unit by means of signal technology.

The voltage measurement unit and the current measurement unit are interchangeable in terms of their arrangement, and are therefore interchangeable in the circuit sequence.

The device simulation unit can be configured as a real device having a device address and its own electronic controller, which can be disposed in the hazard alarm control panel as a completely independent module and without any connection to the control unit.

So-called daughterboards, in particular, can be understood here as real devices with regard to the present invention; these are offered for sale by different manufacturers of loop devices, which are capable of retrofitting devices (for example alarms or actuators) of other manufacturers to make them compatible devices in the device loop.

According to the invention, accordingly, a daughterboard can also be built into the communication circuit of a FAS or HACP, as an independent real device, and allows the same testing possibilities as a microcontroller-controlled current sink in its function as a device simulation unit.

Although the same advantageous testing possibilities of the current measurement unit exist as with the current sink with this arrangement, this solution is generally more cost-intensive and also uses up a device address on the device loop.

In a particularly preferred embodiment of the invention, the device simulation unit is configured as a current sink, preferably as a constant current sink. The current sink can also be configured in multiple stages. The sink can be adapted and configured, depending on the area of application, in such a manner that any desired protocol can be used for modulation of the signal pulses of the communication circuit and on the device loop.

The input transistors of the current sink are connected with the microcontroller port, the control unit of the communication circuit, by way of the signal line, via signal and circuit technology, and this makes it possible to switch and control the current sink.

Furthermore, it is advantageous to configure the hazard alarm system as a fire alarm system and the hazard alarm control panel as a fire alarm and extinguishing control panel, whereby the device loop is configured as a two-wire ring bus system and the devices are configured as signal emitters, alarms, fire alarms, multi-functional alarm systems, actuators, optical or acoustical alarm signaling devices, controllers and circuits for air conditioning systems, device shut-offs, sprinkler systems, and remote alarm signaling devices or the like.

In another preferred embodiment of the invention, a method for testing functional units of the hazard alarm control panel by means of the current sink integrated into the communication circuit and disposed between the functional units current measurement unit and output stage is indicated.

Testing of the functional units is carried out using a device simulation unit.

For this purpose, it is advantageous to carry out the controller and circuit of the device simulation unit by means of the controller implemented in the communication circuit or a separate integrated electronic controller.

Testing of the functional units can take place by means of the device simulation unit, on a device loop separated from the hazard alarm control panel and without occupying a device address on the device loop. Not using up a device address is particularly important to achieve maximal availability of device addresses as compared with competitors.

It is advantageous to carry out testing of the functional units of the hazard alarm control panel by means of the device simulation unit, configured as a current sink or a multi-stage current sink, with the following switching steps:

Coordination and control of the function and the switching schematic of the functional unit by means of the control unit that is preferably configured as a microprocessor system or has a microcontroller, and activation of the current sink by way of the microcontroller port of the current unit.

Furthermore it is advantageous to carry out testing of the functional units of the communication circuit using current measurements according to the following measurement sequence:

a—measuring the quiescent current using the current measurement unit, b—turning on the current sink, c—again measuring the current of the total current composed of current sink and quiescent current, d—turning off the current sink, e—testing the quiescent current for value differences as compared with the measurement in step a, f—determining the current increase from the difference between total current and quiescent current and checking the current increase that has been established for a permissible value.

Furthermore, it is advantageous that the current measurement for testing the functional units with an adapted and optimized current sink can be used for any desired communication protocols and any type of modulation of measurement pulses, up to high-frequency modulation.

Furthermore, it is advantageous, before start-up of the device loop, in addition to the supply voltages and modulation pulses, to also check a current measurement for detection of the current pulses of the devices, so that the device loop is turned on when the reference values of the hazard alarm control panel are reached.

Testing of the functional units of the communication circuit with the device simulation unit such as a current sink can take place at any desired time intervals and also during operation of the device loop. This can be hourly, for example, by analogy to testing the memories of the processors of the device.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, similar reference characters denote similar elements throughout the several views.

DETAILED DESCRIPTION OF THE PREFERRED EMBODIMENT

Figure 1A:
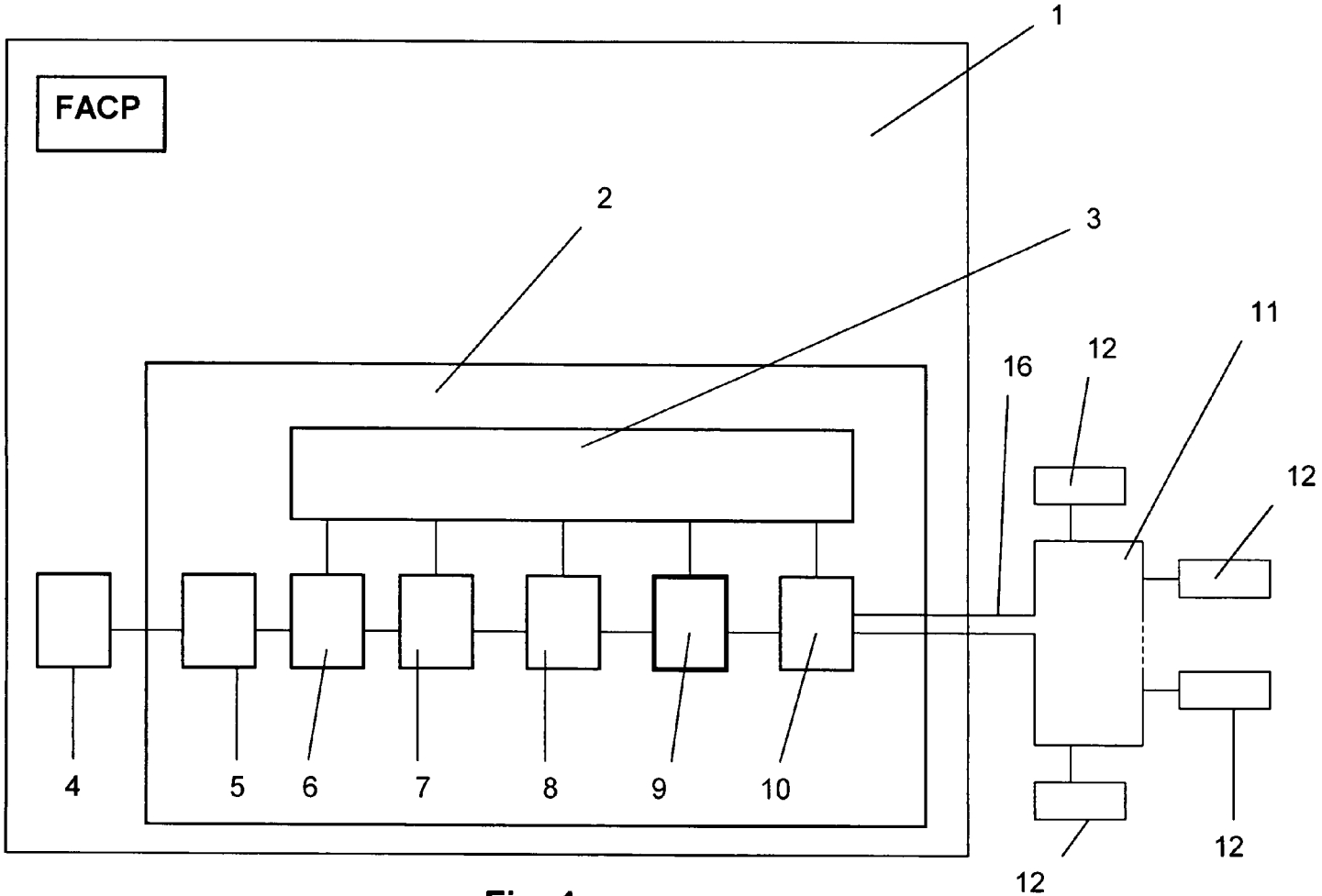
FIG. 1*a* shows a schematic representation of the block diagram of a hazard alarm system (HAS) with a hazard alarm control panel (HACP) 1 configured as a fire alarm control panel, and a device loop 11 with the device simulation unit 9 according to the invention, which is controlled by a microprocessor system of the HACP.

A preferred embodiment of the invention is shown in FIG. 1*a* and relates to a fire alarm system having a fire alarm control panel 1, which is connected with a plurality of devices 12 by way of a connection line 16 and has a voltage supply 5.

In this connection, device loop 11 is structured as a ring bus system, by way of which the devices 12 are connected with communication circuit 2 so that they can be individually addressed.

Different modules and devices can be defined as subscribers devices 12 for monitoring function and status and for transmitting alarms, such as, for example, signal and monitoring transducers, detectors, fire detectors, output devices, multi-function alarm systems, automatic optical or acoustical alarm signaling devices, controls and circuits for air conditioning systems, device shutdowns, extinguishing systems, or remote alarm signaling devices.

The voltage supply of devices 12 takes place by means of fire alarm control panel 1, also by way of connection line 16 configured as a ring bus line. Information, data, and reports regarding the operating states of individual devices 12 are transmitted to fire alarm control panel 1 by way of connection line 16, by means of the ring bus system as a data bus, just like transmission of addresses and commands takes place from the communication circuit 2 to devices 12.

In this connection, communication with the devices 12 takes place via data packets or data words, which are transmitted by modulation of the supply voltage. The devices 12 in turn respond to a received data packet by modulating their current consumption.

The data packets coded by devices 12 in this manner are detected by the current measurement unit 8 and evaluated by the fire alarm control panel 1 with regard to fire alarms, error reports, such as wire break, short circuit and/or operational readiness, as well as other status information.

The connection of device loop 11 to communication circuit 2 of fire alarm control panel 1, in terms of control technology and electronics, is produced by output unit 10. With output unit 10, the connections to one or multiple device loops 11 are used can be interrupted and restored.

Control of functional units 5 to 10 takes place by control unit 3, which can preferably be configured as a microprocessor system, for example. As has been described, testing of the functionality of individual devices 12 essentially takes place by detection of the current pulses by current measurement unit 8 of communication circuit 2.

However, it is not yet possible to arrive at a statement concerning the functionality of current measurement unit 8 itself in this way. Since current measurement unit 8 cannot be tested according to the previous state of the art, it is not possible to differentiate between a missing or defective device 12 on connection line 16 or a defective current measurement by a defective current measurement unit 8.

It follows from this that only insufficient or even incorrect problem reports can be issued, and their clarification requires great effort for measurements and further investigations.

For this reason, statements concerning the status of current measurement unit 8 could only be obtained indirectly until now, by way of examining the test results of the modulated connected device current pulses.

For this test possibility, at least one real device 12 is therefore always required.

Aside from the increased expenditure of time for this, a real loop device 12 always uses an important loop address, which is then not available for other operating functions of the device loop.

It is a disadvantage of previous systems that the device loop is not fully available during this time window, and that a hazard situation might possibly not be recognized and reported. This is where the present invention takes its start.

According to the invention, a device simulation unit is integrated into communication circuit 2 of fire alarm control center 1 (FIGS. 1*a* and 1*b*), with which the functioning ability of current measurement unit 8, in particular, can be tested.

In a particularly preferred embodiment, the device simulation unit is disposed between the two functional units, i.e., current measurement unit 8 and output stage 10.

Implementation of the device simulation unit into communication circuit 2 of fire alarm control center 1 now allows, according to the invention, testing of proper function of functional units 5 to 8, without a connected device loop 11 with diverse devices 12.

To carry out this test, the connection between device loop 11 and current measurement unit 8 is separated by output stage 10, and device loop 11 is simulated by the device simulation unit, configured as current sink 9. Control unit 3 coordinates the time progression and the functions of functional units 6 to 10.

Figure 2:
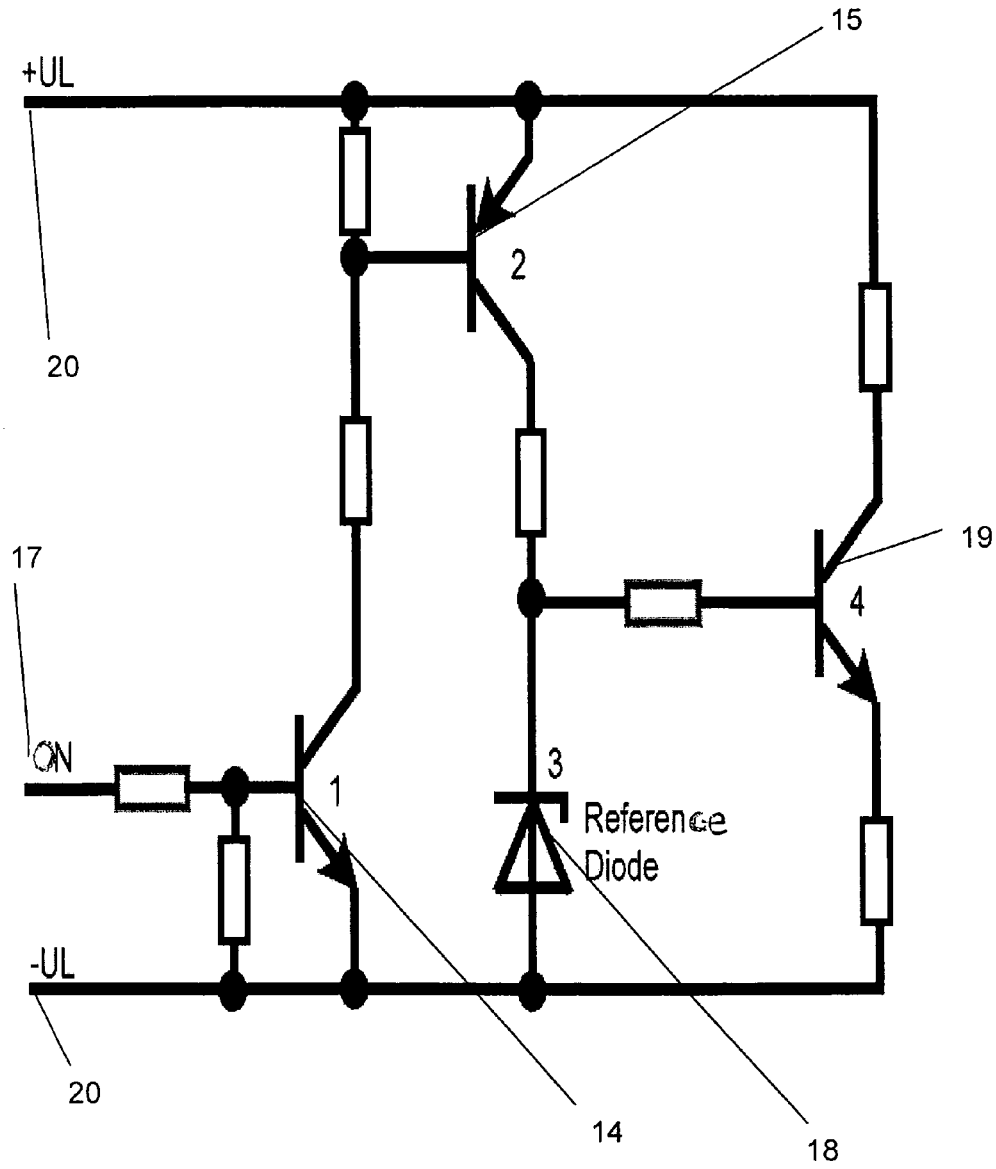
FIG. 2 shows a schematic of a preferred embodiment of the current sink 9 according to the invention, which is activated by means of the microcontroller port of the controller 3 at the signal input 17, by way of the transistors 14 and 15.

In a particularly preferred embodiment, the device simulation unit is configured as a current sink 9. The schematic shown in FIG. 2, of a current sink 9 as an example, shows its electronic structure. In this connection, current sink 9 is preferably structured as a constant current sink 9. A constant current sink 9 has the advantage, as compared with a load resistor, that the desired current load is independent of the level of the supply voltage.

Activation of the current sink 9 takes place by way of the two transistors 14 and 15 connected at signal input 17, by means of the microcontroller port of control unit 3. When current sink 9 is turned on, a constant voltage occurs at reference diode 18, and thus a constant current occurs by way of transistor 19 and its emitter resistor.

The testing method according to the invention will now be described for a current sink 9 as an example.

Accordingly, the test sequence takes place in the following steps:

1. Measuring the quiescent current (IQ) with the current measurement unit 8.
2. Turning on the current sink 9.
3. Measuring the total current (IT), the quiescent current, and the current sink 9 once again.
4. Turning off the current sink 9.
5. Checking the quiescent current. The level of the quiescent current IQ must return to the value from measurement 1, otherwise a defect of current sink 9 must be assumed.
6. Determining the current increase II as a measure of proper functioning of a simulated subscriber.

The determination of the current increase II results from the difference between the total current IT and quiescent current IQ (II=IT−IQ).

Subsequently, a review of the determined current increase as compared with the expected current increase takes place, by means of a comparison of the measurement values with the permissible upper and lower limits stored in the memory of control unit 3.

If the expected correct current increase is not measured, a defective module is reported. Since the module no longer functions correctly, device loop 11 is deactivated.

In this connection, both the review of the quiescent current and the determination of the current increase are carried out by a software implementation of control unit 3. Control unit 3 is preferably configured as a microprocessor or a microcontroller system that controls the stages and circuit components by way of ports. Analog values of the voltage and current measurements are detected by way of the AD inputs of control unit 3.

It is advantageous to check the supply voltage and modulation pulses for devices 12 using the voltage measurement. With the additionally integrated current sink 9, it is now additionally possible, according to the invention, to also review current measurements of the current measurement unit 8 for simulated detection of the current pulses of the devices 12.

With the first embodiment (FIG. 2) of a current sink 9 described here, in general only one pulse or one pulse sequence can be simulated as a device response of current sink 9 to communication circuit 2, while in this connection, the sequence of these measurement pulses can be structured in any desired manner.

Figure 3:
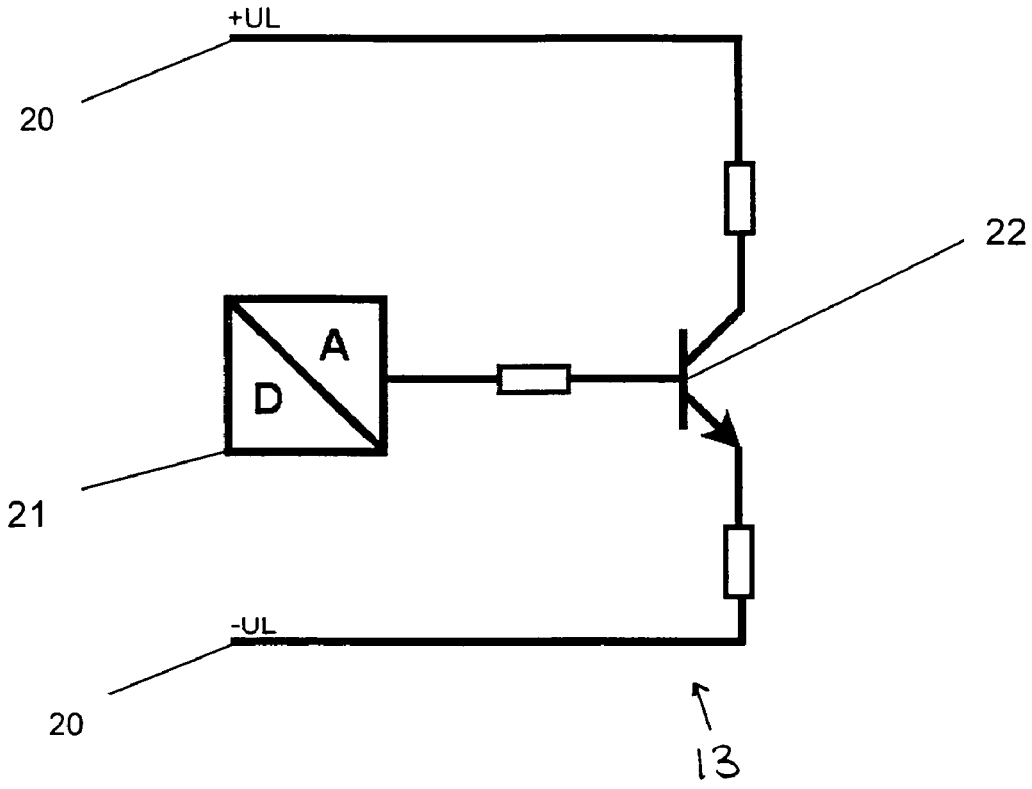
FIG. 3 shows a schematic of a current sink 13 that can be adjusted by way of the DA output of a microcontroller of the control unit 3 of the communication circuit 2.

In another advantageous embodiment shown in FIG. 3, an adjustable current sink 13 is used. Current sink 13 is configured to be adjusted by way of the DA output of the microcontroller of control unit 3. The method of functioning is similar to that of the non-adjustable current sink 9. A voltage determined by the program is output by the microcontroller, by way of the DA output, so that an adjustable, constant current is set by way of the transistor 22. By means of this adjustable current sink 13, communication circuit 2 can also be set to different or higher currents, which then correspond to other loop devices 12 with other protocols or other test sequences with changed parameters (FIG. 3).

In the simulation of a pulse sequence by means of the microcontroller of control unit 3 with current sink 9, 13 as a response of a subscriber 11, it is, of course, possible to further develop current measurement unit 8 and its controller and measurement evaluation in such a manner that the pulse sequence emitted by current sink 9, 13 can be detected and evaluated.

Thus, it can be assumed that the detection of a pulse of current sink 9, 13 by means of current measurement unit 8 is also possible without great changes in circuitry and measurements the detection of additional pulses and/or any desired pulse sequence.

A preferred use of this type of simulation is, for example, the detection of malfunctioning of individual modules of control unit 3 with its microprocessor or microcontroller itself. Here, the possibility, according to the invention, of checking for timing errors, for example, which can occur due to a defective oscillator of the microcontroller, is particularly pointed out. In terms of measurement technology, in this connection, a specific pulse sequence must be generated by a second microcontroller with its own time base, and applied to the simulation unit configured as current sink 9, 13 and the detection and evaluation of this sequence, using the current measurement unit 8, can give indications concerning the error cause of the first microcontroller. For such cases, there are useful application possibilities for the use of a simulated pulse sequence.

In all cases, the measurement values of the current measurements (current increase values) pulses or detected pulse sequences have to be in the restricted tolerance ranges stored in memory. Only in this case can perfect functionality of the communication circuit 2 with its functional units 5 to 10 be assured, and the subscriber loop 11 can be switched on.

In summary, the switching and measurement sequence when the functional units 3 to 10 shown in FIG. 1 are started up will be indicated once again. If errors are detected by communication circuit 2, loop circuit 1, 2 is deactivated immediately, and a detailed error report is issued, if necessary.

1. Turn subscriber loop voltage on.

2. Measure rest current of the subscriber loop 11 and compare it with the reference value.

3. Measure subscriber loop voltage and compare it with the reference value.

4. Turn voltage pulse 6 on, measure the pulse voltage level and compare it with the reference value. Turn the voltage pulse off again.

5. Turn constant current sink 9 on, measure current, determine difference from rest current and compare it with the reference value. Turn current sink off again.

5a. Using the adjustable current sink 13, it is possible to check different test currents and thus also to recognize other errors in non-linearity of the current measurement.

6. If communication circuit 2 is running within the parameters provided, with subscriber simulation unit configured as current sink 9 according to the invention, output unit 10 to device loop 11 is turned on and communication circuit 2 can assume its intended functions and communicate with devices 12.

The current measurement according to the invention, by means of current measurement unit 8, of the current pulses produced by means of current sink 9, 13, can be made during operation of device loop 11, between the device queries by means of communication circuit 2, or at any desired intervals.

Since an hourly rhythm is provided for checking the memory areas of microprocessors, for example, there is also a one-stage or multi-stage current sink 9 or an adjustable current sink 13 for checking the current measurement unit 8.

Furthermore, it also lies within the scope of the invention to provide equivalent circuit arrangements for current sinks or other regulatable electronic loads having comparable functionality, for the present testing method according to the invention, and to integrate them into the given electronic infrastructure for hazard alarms and their communication and testing modules.

Figure 1B:
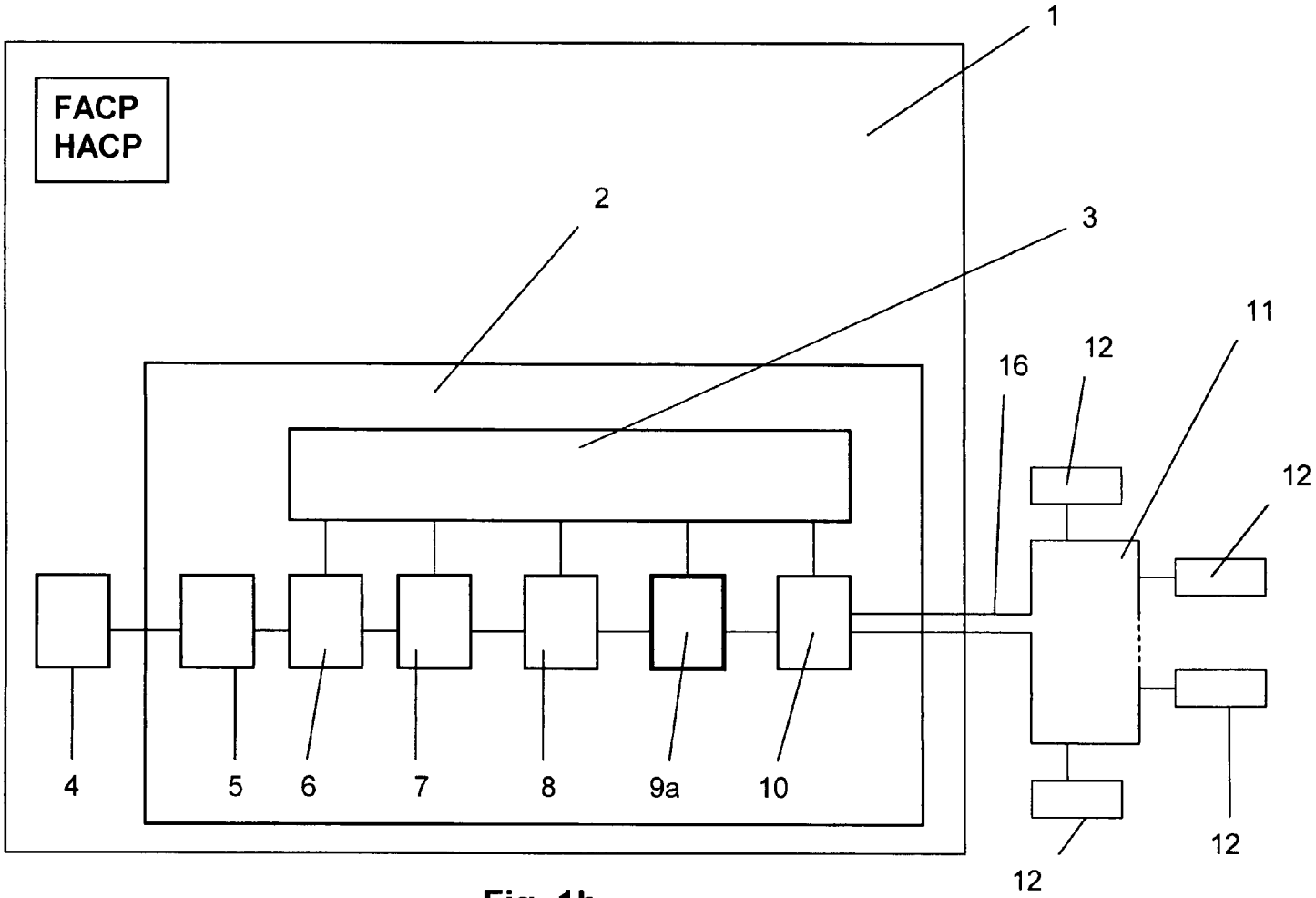
FIG. 1*b* shows a schematic representation of a hazard alarm system (HAS) with a hazard alarm control panel (HACP) 1 configured as a fire alarm control panel, and a device loop 11 with the device simulation unit 9 according to the invention, which is contained in the communication circuit as a real device 9*a*.

Another embodiment of the invention relates to the configuration of the device simulation unit as a real device 9*a*, which is preferably integrated into the fire alarm control panel 1 and has an independent control unit without a connection to the communication circuit 2 (FIG. 1*b*). Real devices 9*a* suitable for this purpose are configured specifically for these purposes and have accordingly adapted boards and microprocessor systems that can generate the required current pulse response for the communication circuit 2.

In this embodiment, the testing device according to the invention is then formed by a modified real device 9*a* in the FACP, instead of by a current sink 9 controlled by a microcontroller. With this arrangement, it is fundamentally possible to carry out the same tests of the functional units 5 to 8, 10 as with the current sink 9.

In another alternative embodiment, the device simulation unit can also be disposed outside of the fire alarm control panel, externally on the device loop 11.

However, in this external embodiment, some advantages are lost as compared with the integrated embodiments of the current sink 9 described above. In the case of an external placement on the device loop 11, there is the risk that in the event of a problem on the loop (for example wire break on both sides), it can no longer be distinguished without doubt whether or not the current measurement is functioning properly or whether no device is present.

In another advantageous embodiment of the invention, an interchange of the measurement sequence of the voltage measurement unit 7 with the current measurement unit 8 is proposed. For this purpose, the placement of the voltage measurement unit 7 is interchanged with the current measurement unit 8 of the communication circuit 2.

The testing method according to the invention that is present in this embodiment can be advantageously used, in this sense, even if the two measurements are interchanged in their sequence. However, it must be guaranteed that the current sink 9 follows the current measurement.

In principle, an interchange of the current measurement and voltage measurement influences the measurement of correct current or voltage. If the voltage measurement follows the current measurement, then the correct voltage is measured, because the measured current also includes the current that is needed for voltage measurement (voltage divider and current in the AD input of the microcontroller). If, on the other hand, the current measurement follows the voltage measurement, then the correct current is measured, because the voltage at the output is lower by the voltage drop of the current measurement resistance (shunt). Depending on the emphasis of the measurement to be established, one of the two arrangements is preferred.

In another preferred embodiment of the invention, current sink 9 of the testing device according to the invention is adapted or optimized in such a manner that the testing method according to the invention, particularly the current measurement method of the communication circuit 2, can advantageously be used even when any desired communication protocol is used. In this connection, the modulation of the signal pulses for the communication between device loop 11 and communication circuit 2 can take place up to high-frequency modulation.

This embodiment is particularly advantageous when communication protocols for devices 12 of different manufacturers are being used, since the modulation modes and signal frequencies of the different manufacturers differ from one another.

Thus, loop devices 12 are addressed by the FACP and their data are transmitted on the basis of any desired modulation of the supply voltage. Devices 12 in turn respond by means of any type of modulation of their response current pulses.

Thus, for example, a pulse length modulation with an increase in the supply voltage can be used for data transmission and as a protocol for communication with loop devices 12.

The devices then respond in a special protocol, bit by bit, in the bit window defined by the FACP by means of voltage pulses. The testing method according to the invention can be used for different modulation protocols by means of this current sink 9, which is adapted and optimized accordingly for these cases of use.

The integration, according to the invention, of a current sink 9 into the communication circuit 2 of the fire alarm control panel 1 allows rapid and reliable calibration of the current measurement circuit of the FACP.

In this way, an internal functional test of communication circuit 2 of the FACP is possible while device loop 11 is shut off and without any real external loop device 12. Thus, the functions transmission and reception of protocol data of communication circuit 2 can particularly be checked for proper functioning.

The testing method presented and the testing device according to the invention particularly have the advantage that a regular test possibility for important functional units of a HACP/FACP, which can be carried out at any desired time intervals, is made available, without important addresses on the device loop being blocked. Furthermore, the incorrect or confusing error messages that frequently occur in connection with the current tests can be avoided.

Accordingly, while only a few embodiments of the present invention have been shown and described, it is obvious that many changes and modifications may be made thereunto without departing from the spirit and scope of the invention.

REFERENCE SYMBOL LIST

1 hazard alarm control panel, fire alarm control panel
2 communication circuit (3, 6, 7, 8, 9, 10)
3 control unit with microprocessor system or microcontroller
4 voltage supply of the HACP/FACP
5 voltage supply of the device loop 11
6 voltage pulse generator
7 voltage measurement unit
8 current measurement unit
9 device simulation unit as a current sink
9*a* real device as a device simulation unit
10 output unit
11 device loop (consisting of connection line 16 and devices 12)
12 loop device, device (alarm, fire alarm, alarm signaling device, . . . )
13 adjustable current sink or multi-stage current sink
14 transistor 1 of the current sink
15 transistor 2 of the current sink
16 connection line
17 signal input of the current sink 9
18 reference diode 3 of the current sink 9
19 transistor 4 of the current sink 9
20 input supply voltage of the device loop 11
21 DA output of the microcontroller from control unit 3
22 transistor of the adjustable current sink 13

What is claimed is:

1. A testing device for hazard alarm systems, comprising:
a hazard alarm control panel;
at least one device loop having a plurality of devices connected to the hazard alarm control panel; and
at least one communication circuit for communication with individual devices of the device loop and their control, the communication circuit comprising the following functional units:
a voltage supply of the device loop;
a control unit configured as a microprocessor or a microcontroller;
a voltage pulse generator;
a voltage measurement unit;
a current measurement unit;
an output unit; and
and at least one device simulation unit,
wherein said at least one device simulation unit is adapted for testing functionality of the current measurement unit and thus of the hazard alarm control panel, and wherein testing of the functionality of the current measurement unit as well as of the entire communication circuit takes place by means of software implementation of the control unit.

2. The testing device according to claim 1, wherein the device simulation unit is integrated into the communication circuit of the hazard alarm control panel or is disposed externally of the communication circuit.

3. The testing device according to claim 2, wherein the control unit is configured as a microprocessor or microcontroller and the functional units are switched one behind the other in the following sequence:
voltage supply,
voltage pulse generator,
voltage measurement unit,
current measurement unit,
subscriber simulation unit,
output unit,
connection of the device loop by means of a connection line;
wherein the functional units are connected with the control unit by means of signal technology, and wherein the voltage measurement unit and the current measurement unit are interchangeable in terms of their placement and circuit sequence.

4. The testing device according to claim 1, wherein the device simulation unit is configured as a real device having its own device address and its own electronic control, and is disposed in the hazard alarm control panel as a completely independent module or an integral part of the communication circuit, and wherein the real device is specifically configured for the testing device and has a board and a microprocessor specifically adapted for the testing device.

5. The testing device according to claim 1, wherein the device simulation unit is configured as a current sink whose control and signal evaluation takes place by a microprocessor or a microcontroller of the control unit, wherein input transistors of the current sink are connected with a port of the microcontroller or the microprocessor by way of a signal line using signal and circuit technology.

6. The testing device according to claim 5, wherein the current sink is configured as a constant current sink, as a multi-stage current sink, or as a current sink that can be adjusted by means of a microcontroller or microprocessor, wherein the current sink is adapted and configured so that any desired communication protocol can be used for modulation of the signal pulses of the communication circuit and on the device loop.

7. The testing device according to claim 1, wherein the hazard alarm system is configured as a fire alarm system, and the hazard alarm control panel is configured as a fire alarm and extinguishing control panel, wherein the connection line is configured as a ring bus system and the devices are selected from the group consisting of signal transmitters, detectors, fire detectors, multi-functional alarm systems, automatic optical or acoustical alarm signaling devices, controls and circuits for air conditioning systems, device shut-offs, sprinkler systems, and remote alarm signaling devices.

8. A method for testing a current measurement unit of a communication circuit of a hazard alarm system that has a hazard alarm control panel, at least one device loop having a plurality of devices connected to the hazard alarm control panel, and at least one communication circuit for communication with individual devices of the device loop and their control, the communication circuit comprising the following functional units:
a voltage supply of the device loop;

a control unit configured as a microprocessor or a microcontroller;

a voltage pulse generator;

a voltage measurement unit;

a current measurement unit;

an output unit; and and at least one device simulation unit, the method comprising the step of testing functionality of the current measurement unit using the device simulation unit, wherein said step of testing also tests the hazard alarm control panel, and wherein the step of testing takes place by software implementation of the control unit.

9. The method according to claim 8, wherein the device simulation unit is configured as a current sink, multi-stage current sink, or adjustable current sink, and the step of testing the functionality of the current measurement unit comprises:

separating the device loop from the hazard alarm control panel with the output stage of the communication circuit;

controlling functions and switching schematics of the functional units with the control unit, the control unit being configured as a microprocessor system or has a microcontroller; and activating the current sink by with a microcontroller port of the control unit.

10. The method according to claim 9, wherein testing of the current measurement unit of the communication circuit is carried out by current measurements and software implementation of the control unit configured as a microprocessor or microcontroller and of the device simulation unit according to the following measurement sequence:

a. measuring a quiescent current of the communication circuit;

b. turning on the current sink;

c. measuring the current of a total current composed of current sink and communication circuit;

d. turning off the current sink;

e. testing a quiescent current for value differences as compared with the measurement in step a; and f. determining a current increase from a difference between total current and quiescent current and checking the current increase that has been established for a permissible value.

11. The method according to claim 9, wherein the test sequence of a device loop with devices provided by software implementation of the control unit of the communication circuit comprises the following method steps:

a. turning on loop voltage;

b. measuring loop rest current and comparing it with a reference value;

c. measuring loop voltage and comparing it with a reference value;

d. turning on a voltage pulse with a voltage pulse generator, measuring a pulse voltage level with the voltage measurement unit and comparing a measured pulse voltage level with the reference value and turning the voltage pulse off again;

e. turning on a constant current sink, measuring the current, determining a difference from the quiescent current and comparing the difference with the reference value and, turning the current sink off again; and f. after the reference values have been reached, turning on the output stage to activate communication with the devices of the subscriber loop.

12. The method according to claim 11, further comprising the step of checking additional different test currents of the current measurement unit with a current sink that is adjustable by way of a DA output of the microcontroller, to recognize errors in non-linearity in the current measurement.

13. The method according to claim 8, wherein the device simulation unit is configured as a current sink and wherein testing of the current measurement unit of the communication circuit is adapted to take place with the device simulation unit at any desired time interval and during operation of the device loop.

14. The method according to claim 13, wherein control of the current sink takes place by means of a microcontroller so that a pulse or a pulse sequence is generated as a response of a device.

* * * * *